US012781632B2

(12) United States Patent
Birk et al.

(10) Patent No.: US 12,781,632 B2
(45) Date of Patent: Nov. 3, 2026

(54) AXIAL PISTON MACHINE WITH RETRACTION PLATE FOR HIGH ROTATIONAL SPEEDS

(71) Applicant: Robert Bosch GmbH, Stuttgart (DE)

(72) Inventors: Sebastian Birk, Sulz (DE); Timo Nafz, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 44 days.

(21) Appl. No.: 18/749,354

(22) Filed: Jun. 20, 2024

(65) Prior Publication Data

US 2025/0003338 A1 Jan. 2, 2025

(30) Foreign Application Priority Data

Jun. 29, 2023 (DE) ..... 10 2023 206 128.7

(51) Int. Cl.
*F01B 3/00* (2006.01)

(52) U.S. Cl.
CPC ..... *F01B 3/007* (2013.01); *F01B 3/0088* (2013.01)

(58) Field of Classification Search
CPC ..... F01B 3/088; F01B 3/077; F04B 1/126; F04B 1/2014; F04B 1/22; F04B 1/2078
See application file for complete search history.

(56) References Cited

U.S. PATENT DOCUMENTS 3,382,793 A 5/1968 Gantzer
9,856,851 B2 1/2018 Kato et al.

FOREIGN PATENT DOCUMENTS

DE 102014215024 A1 * 3/2015 ..... F04B 1/2078
DE 10 2015 208 886 A1 11/2016
DE 10 2020 202 316 A1 8/2021
EP 1 561 031 B1 2/2006

* cited by examiner

*Primary Examiner* — Nathaniel E Wiehe
*Assistant Examiner* — Daniel S Collins
(74) *Attorney, Agent, or Firm* — Maginot, Moore & Beck LLP

(57) ABSTRACT

An axial piston machine includes a retraction plate, first apertures of which are each penetrated by an associated sliding shoe. A joint section of the sliding shoe deviates from a circular cylindrical shape such that it has a largest diameter which is spaced apart from the web section, wherein the joint section has a reduced diameter between the largest diameter and the web section compared to the largest diameter. In a reference state, the joint section contacts an inner circumferential surface of the associated first aperture such that a minimum distance is obtained between the web section and the spherical outer surface section, and the inner circumferential surface of the first aperture is adapted to the non-circular cylindrical joint section of the sliding shoe such that the inner circumferential surface and the joint section contact each other in the reference state away from the largest diameter of the joint section.

12 Claims, 4 Drawing Sheets

AXIAL PISTON MACHINE WITH RETRACTION PLATE FOR HIGH ROTATIONAL SPEEDS

This application claims priority under 35 U.S.C. § 119 to application no. DE 10 2023 206 128.7, filed on Jun. 29, 2023 in Germany, the disclosure of which is incorporated herein by reference in its entirety.

The disclosure relates to an axial piston machine.

BACKGROUND

An axial piston machine in swashplate design is known from U.S. Pat. No. 3,382,793. During suction, the pistons are pulled out of the cylinder bores by means of a retraction plate. The sliding shoes on the pistons are supported by means of an annular surface on a completely flat first end face of the retraction plate. The retraction plate is supported on a retraction ball, which in turn is supported on the cylinder drum via a spring. The retraction plate is thicker radially on the inside than radially on the outside. This achieves the required rigidity of the retraction plate, wherein the maximum possible swivel angle is little affected by the thin outer retraction plate.

US 9 856 851B2 describes another comparable retraction plate in an axial piston machine with a swashplate design.

A slightly differently shaped retraction plate is known from EP 1 561 031 B1, in which a ring-like projection is provided on the retraction plate in the area of the retraction ball. Among other things, this serves to stiffen the retraction plate. This ring-like projection is not to be used in the context of the present disclosure precisely because, contrary to the axial piston machine described below, it requires sliding shoes running radially further outwards.

DE 10 2020 202 316 A1 and DE10 2015 208 886 A1 disclose tapered sliding shoes in which the rotationally symmetrical joint section next to the web section is not circular-cylindrical but tapered. Accordingly, the joint section has a largest diameter, wherein the area between the web section and the largest diameter is designed with a smaller diameter.

SUMMARY

The disclosed axial piston machine in swashplate design can be operated at a high rotational speed. In this case, the pistons are loaded with high centrifugal forces.

Accordingly, the unsupported length with which a maximally extended piston protrudes from the cylinder drum should be particularly small so that the centrifugal forces occurring during operation cause a low bending moment on the piston. Furthermore, the diameter on which the centers of the ball joints between the sliding shoe and piston run should be particularly small so that the centrifugal forces acting on the sliding shoes are small.

According to the disclosure, the joint section of the sliding shoe deviates from a circular cylindrical shape such that it has a largest diameter which is spaced apart from the web section, wherein said joint section has a reduced diameter between the largest diameter and the web section compared to the largest diameter, wherein in a reference state, the joint section contacts an inner circumferential surface of the associated first aperture such that a minimum distance is obtained between the web section and the spherical outer surface section, wherein the inner circumferential surface of the first aperture is adapted to the non-circular cylindrical joint section of the sliding shoe such that said inner circumferential surface and the joint section contact each other in the reference state away from the largest diameter of the joint section.

The control surface is preferably planar. It can be arranged in a stationary position on a housing of the axial piston machine. Preferably, a separate swivel cradle is provided which can be swiveled relative to the housing, wherein the control surface is arranged on the swivel cradle. The said distance between the first and second end faces preferably changes continuously, wherein it most preferably decreases monotonically from the inside to the outside, wherein areas with a constant distance may be present. A smallest diameter of a first aperture is preferably larger than the largest diameter of the joint section. All sliding shoes are preferably identical to one another. All first apertures are preferably identical to one another, wherein they are uniformly distributed around the circumference of the retraction plate. In the reference state, the annular surface of the sliding shoe in particular is in contact with the flat first end face of the retraction plate, wherein the spherical outer surface section of the retraction ball is in contact with the second aperture of the retraction plate. At the largest diameter of the joint section, there may be contact with the inner circumferential surface of the first aperture in the reference state. Preferably, however, there is a small distance so that there is a defined point of contact away from the largest diameter.

It may be provided that the joint section of the sliding shoe comprises a first circular cylindrical section whose diameter is smaller than the largest diameter of the joint section, wherein the first circular cylindrical section is arranged between the web section and said largest diameter, wherein the inner circumferential surface of the first aperture comprises a second circular cylindrical section, wherein in the reference state the first and second circular cylindrical sections touch each other. This means that the smallest gap between the first and second circular-cylindrical sections of the fully assembled axial piston machine can be very small, wherein there is still no risk of contact. The sliding shoes can therefore be arranged close to the rotation axis, which minimizes the centrifugal forces acting on the sliding shoes.

It may be provided that the second circular cylindrical section forms a corner with the first end face, if desired rounded or chamfered. Accordingly, the first circular-cylindrical section is arranged directly adjacent to the first end face. It is thus also present radially on the outside of the first aperture, although the retraction plate has a small thickness there.

It may be provided that the inner circumferential surface of the first aperture is widened in a funnel shape away from the second circular cylindrical section. This takes account of the largest diameter of the joint section. The exact shape of the funnel-shaped widening is not important in the context of the disclosure, as long as it is ensured that in the reference state there is the required contact away from the largest diameter.

It may be provided that the variable distance between the first and second end faces is such that the funnel-shaped extension is present at a radially inner edge of the first aperture, wherein only the second circular cylindrical section is present at a radially outer edge of the first aperture.

The thickness of the retraction plate at the radially outer edge determines the maximum length with which the pistons can protrude from the associated cylinder bore. With the proposed design, this length can be minimized so that the bending moments on the pistons caused by the centrifugal forces are also minimized.

It may be provided that the axial piston machine is designed in such a way that the reference state can only be reached when at least part of the axial piston machine is dismantled and/or when the axial piston machine is not pressurized ready for operation, so that during the intended operation of the axial piston machine there is always at least some clearance between the sliding shoe and the associated first aperture. The corresponding contact would cause noise and/or wear during operation, which is undesirable.

It may be provided that an inner circumferential surface of the second aperture comprises a first and second rotationally symmetrical section which are directly adjacent to each other, wherein the first rotationally symmetrical section is arranged adjacent to the first end face, wherein it is formed so as to be able to contact the spherical outer surface section of the retraction ball over the entire circumference, wherein at the same time the second rotationally symmetrical section is arranged at a distance from said spherical outer surface section. The retraction plate is preferably thick on the inside radially to ensure the required rigidity. With the above design, contact between the retraction plate and the retraction ball can still be achieved very close to the first end face, so that undesirable tilting moments on the retraction plate are avoided.

It may be provided that the second rotationally symmetrical section is spherical in shape, wherein the corresponding spherical radius is larger than a spherical radius of the spherical outer surface section of the retraction ball.

In this way, the desired distance between the surfaces mentioned can be reliably achieved.

It is possible that the first rotationally symmetrical section is shaped like a circular cone. This results in a defined line-like contact on the entire circumference of the retraction ball. The distance between the first end face and said contact is preferably a small dimension other than zero.

It may be provided that the second rotationally symmetrical section is shaped like a circular cone, wherein an inclination angle between the first rotationally symmetrical section and a central axis of the second aperture is greater than an analogous inclination angle at the second rotationally symmetrical section. This can simplify the production of the second aperture by approximating the ideal spherical shape of the second rotationally symmetrical section by a circular cone shape.

It may be provided that the spherical outer surface section extends to an end of the retraction ball facing the cylinder drum so that the retraction plate can be pivoted beyond said end, wherein the variable distance between the first and second end faces of the retraction plate is such that a gap of constant width is formed between the second end face of the retraction plate and the cylinder drum in a swivel position of the retraction plate. The said swivel position preferably corresponds to the maximum intended swivel angle of the swivel cradle during operation. It is understood that the swivel cradle could be swiveled out further until the retraction plate touches the cylinder drum. The preferred end stops for the swivel cradle are preferably set so that the required swivel position is the end position. With this design, the pistons protrude only slightly from the cylinder drum, even at maximum displacement volume, so that the centrifugal forces explained at the beginning cause a low bending moment on the pistons.

It is understood that the aforementioned features and the features yet to be explained below can be used not only in the respectively specified combination but also in other combinations or alone, without leaving the scope of the present disclosure.

BRIEF DESCRIPTION OF THE DRAWINGS

The disclosure is explained in more detail below with reference to the enclosed drawings. The drawings show.

DETAILED DESCRIPTION

Figure 1:
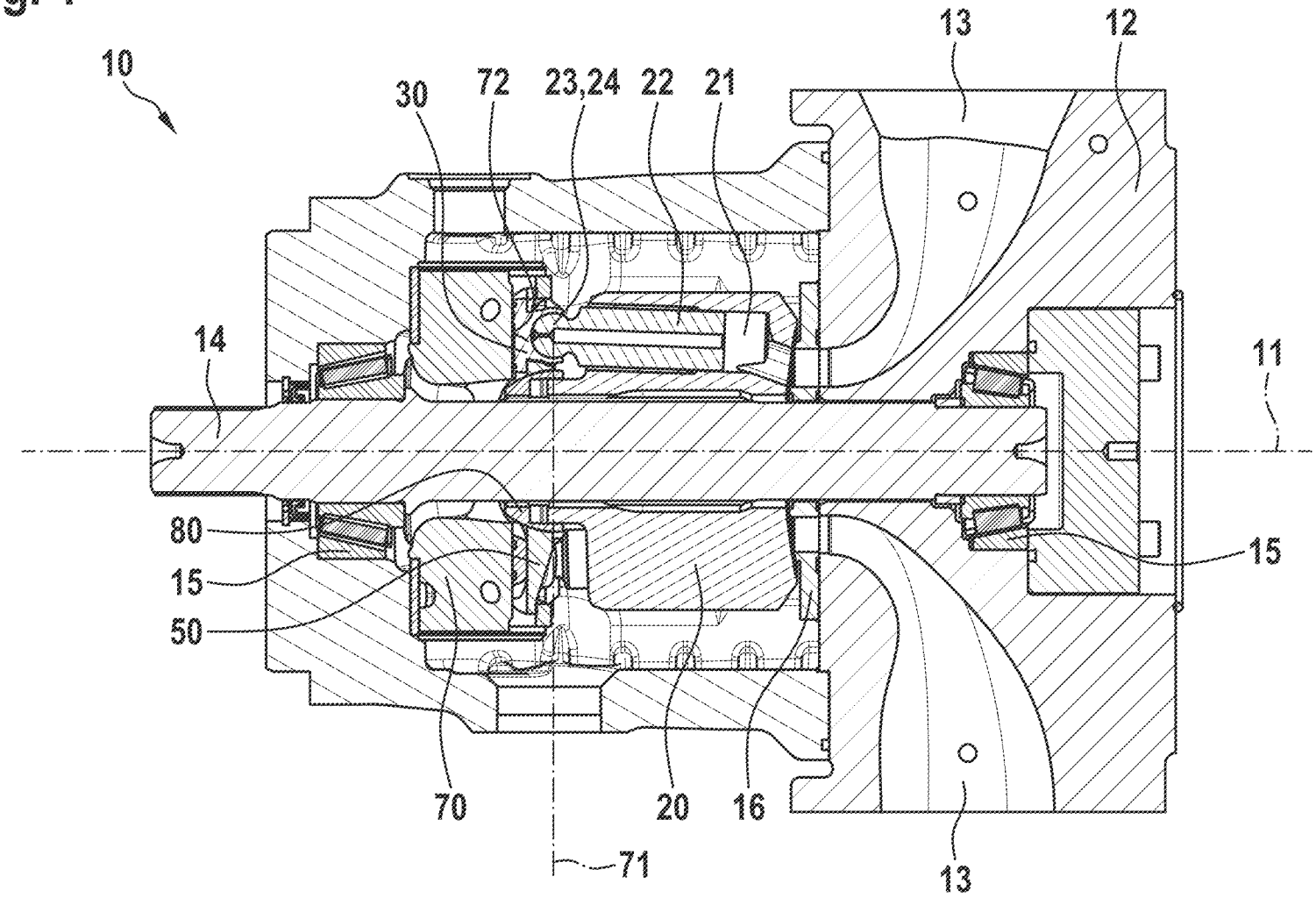
FIG. 1 a longitudinal section of an axial piston machine according to the disclosure.

FIG. 1 shows a longitudinal section of an axial piston machine 10 according to the disclosure. The axial piston machine 10 comprises a housing 12 in which a drive shaft 14 is rotatably mounted with respect to a rotation axis 11. The two corresponding rotary bearings 15 are designed as tapered roller bearings. Inside the housing 12, the drive shaft 14 is surrounded by a cylinder drum 20 and is connected to it by a splined toothed shaft in a rotary drive connection. A plurality of pistons 22 are accommodated in the cylinder drum 20 so that they are linearly movable. Together with the cylinder drum 20, each piston 22 defines a cylinder chamber 21, the volume of which changes periodically when the cylinder drum 20 rotates.

At the right-hand end in FIG. 1, the cylinder drum 20 rests against a separate distribution plate 16, which is permanently connected to the housing 12. The distribution plate 16 has two kidney-shaped control openings, each of which is permanently connected to an associated working port 13. The cylinder chambers 21 each have an orifice which can be brought into overlap with the kidney-shaped control openings in such a way that the rotation of the cylinder drum 20 is accompanied by a fluid flow between the two working ports 13. The corresponding pressurized fluid is preferably a liquid and most preferably hydraulic oil.

A separate swivel cradle 70 is arranged on the side of the cylinder drum 20 facing away from the distribution plate 16, which can be swiveled relative to the housing 12 with respect to a swivel axis 71. The corresponding swivel movement is brought about by means of a support cylinder, which is not visible in FIG. 1. In the present case, the swivel axis 71 intersects the rotation axis 11 at a right angle. However, it is also conceivable that the swivel axis 71 crosses the rotation axis 11 at a distance. The swivel cradle 70 has a flat control surface 72, the inclination of which relative to the rotation axis 11 determines the displacement volume of the axial piston machine 10.

Each piston 22 is connected to an associated sliding shoe 30 via a ball joint 23, wherein the sliding shoe 30 is in sliding contact with the control surface 72.

A hydrostatic pressure field is provided between the sliding shoe 30 and the control surface 72, which is supplied with pressure from the associated cylinder chamber 21.

In order to pull the pistons 22 out of the cylinder drum 20 during suction, a separate retraction plate 50 is provided, which is supported on the cylinder drum 20 via a separate retraction ball 80. When the swivel cradle 70 is adjusted, an axial relative movement can take place between the retraction ball 80 and the cylinder drum 20, which is why these parts are designed separately from one another.

Figure 2:
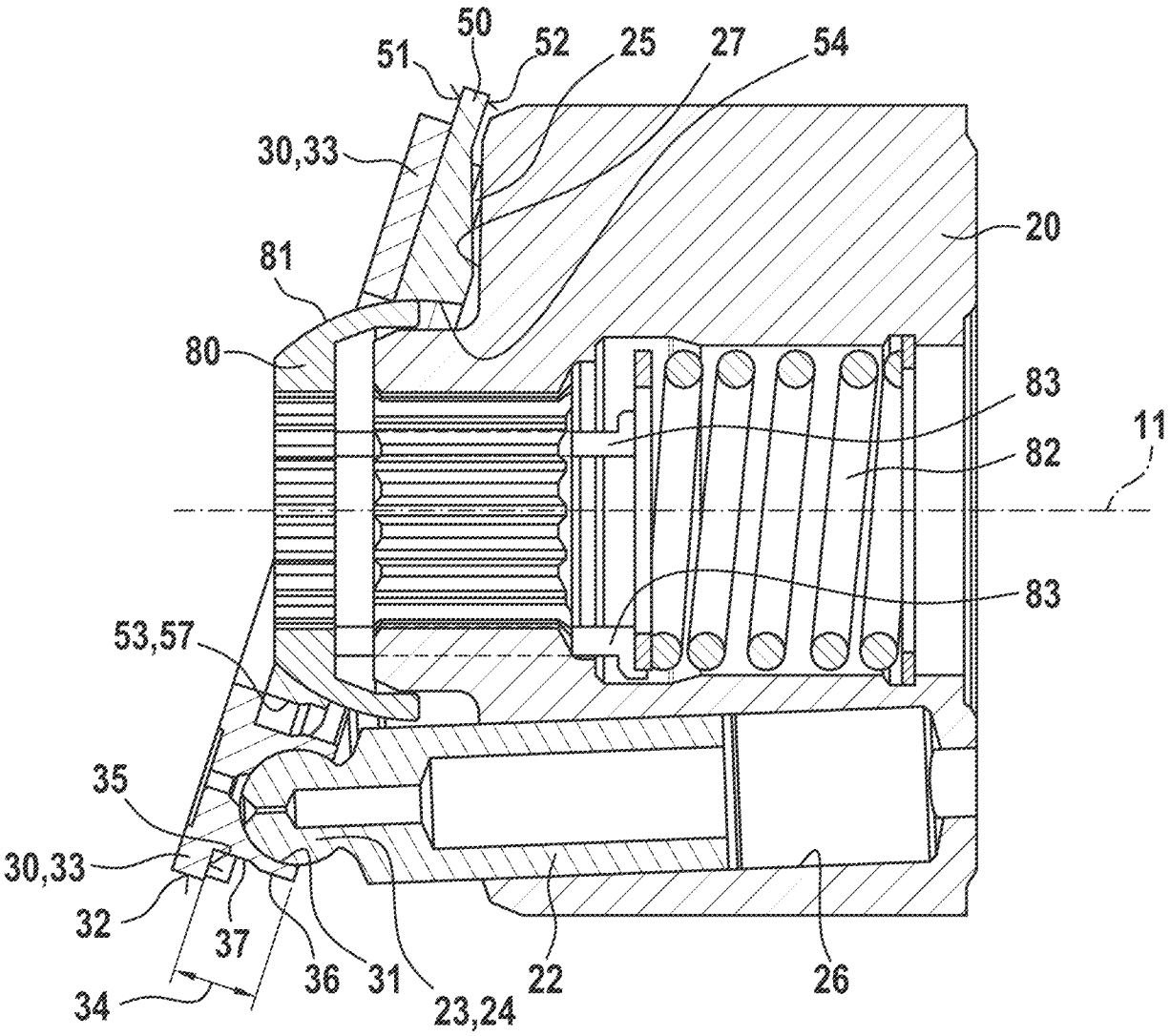
FIG. 2 a longitudinal section of a cylinder drum with a retraction plate according to the disclosure.

FIG. 2 shows a longitudinal section of a cylinder drum 20 with a retraction plate 50 according to the disclosure. A position of the retraction plate 50 is shown in which the swivel cradle (no. 70 in FIG. 1) assumes the maximum swivel angle that occurs during operation. In order to achieve the desired high speed stability, the lower piston 22 in FIG. 2 should protrude as little as possible from the cylinder drum 20, as the corresponding projection length determines the bending moment which acts on the piston 22 due to the centrifugal forces occurring during operation. As a result, the sliding shoes 30 on the opposite side of the rotation axis 11 plunge into the cylinder bore 26, into which the associated piston 22 runs. The largest diameter 36 of the joint area 34 of a sliding shoe 30 is therefore preferably smaller than the diameter of the aforementioned cylinder bore 26. Due to the tilting of the sliding shoes 30, a first circular cylindrical section 37 is also provided on the joint section 34 of a sliding shoe 30, the diameter of which is smaller than the largest diameter 36 in order to avoid a collision between the cylinder bore 26 and the sliding shoe 30.

The retraction ball 80 has a spherical outer surface section 81, the center of which preferably coincides with the rotation axis 11. The spherical outer surface section 81 extends in the direction of the rotation axis 11 over the entire length of the retraction ball 80. The two ends of the spherical outer surface section 81 pointing in the direction of the rotation axis 11 are formed such that the central second aperture 54 of the retraction plate 50 can move over the end of the spherical outer surface section 81, as is the case in FIG. 2 above. This enables a large axial movement of the retraction ball 80. Within the scope of this mobility, the retraction ball 80 is supported in the direction of the rotation axis 11, for example via the pressure pins 83 known from EP 1 604 113 B1 and a coil spring 82 on the cylinder drum 20. It is also conceivable to install disk springs in the space marked No. 84 between the retraction ball 80 and the cylinder drum 20, in particular if only slight axial movement of the retraction ball 80 is required. The retraction ball 80 is preferably pot-shaped, wherein it surrounds a circular cylindrical extension of the cylinder drum 20 pointing in the direction of the rotation axis 11.

The ball diameter of the spherical outer surface section 81 is selected to be as large as possible, wherein a collision between the retraction ball 80 and the pistons 22 is nevertheless reliably excluded. At the same time, the pistons 22 should be arranged as close as possible to the rotation axis 11 in order to minimize the centrifugal forces occurring during operation. The retraction plate 50 according to the disclosure is designed in such a way that the conflicting requirements explained above can be fulfilled in the best possible way.

The rotationally symmetrical outer circumferential surface 32 of a sliding shoe 30 comprises a web section 33 and a joint section 34. The joint section 34 forms the ball socket 31 of the ball joint 23 on the inside. The outer diameter of the web section 33 is larger than the largest diameter 36 of the joint section 34.

At the transition between the web section 33 and the joint section 34, this results in an annular surface 35, which is preferably flat and perpendicular to the axis of symmetry of the rotational symmetry of the sliding shoe 30. With the annular surface 35, the sliding shoe 30 rests against a flat first end face 51 of the retraction plate 50. The web section 33 is preferably circular-cylindrical.

No contours are provided on the retraction plate 50 which protrude beyond the flat first end face 51 towards the swivel cradle 70. In particular, no ring-like reinforcing projection is arranged around the central second aperture 54. This design makes it possible to move the web section 33 very close to the spherical outer surface section 81, for example when, contrary to the illustration in FIG. 2, the displacement volume is set to zero. In this state, the joint section 54 of the sliding shoe is arranged very close to the radially inner edge of the associated first aperture 53 in the retraction plate 50.

It should be noted here that the diameter of a first aperture 53 is noticeably larger than the largest diameter 36 of the joint section 34. As a result, a sliding shoe 30 can move within the first aperture 53 in order to compensate for the distance between the sliding shoe 30 and the rotation axis 11, measured in a direction parallel to the control surface (No. 72 in FIG. 1), which varies during one revolution of the cylinder drum 20. This distance is constant and smallest at displacement volume zero.

In the context of the disclosure, in particular the cross-sectional shape of the first aperture 53 is adapted to the non-circular cylindrical shape of the respective associated joint section 34 in order to enable the smallest possible minimum distance between the web section 33 and the spherical outer surface section 81.

In the present retraction plate 50, the required rigidity is achieved by the fact that the second end face 52 facing away from the first end face 51 is not flat. Rather, the distance between the first and second end faces 51; 52 or the thickness of the retraction plate 50 is significantly greater radially on the inside than radially on the outside. The corresponding thickness curve is selected such that, at the maximum displacement volume shown in FIG. 2, a gap 25 of constant width is produced between the retraction plate 50 and the cylinder drum 20. The corresponding end face 27 of the cylinder drum 20 is in any case flat around the pistons 22 and perpendicular to the rotation axis 11, so that the pistons 22 are supported in the best possible way by the respectively assigned cylinder bore 26.

At the radially outer edge, the retraction plate 70 has an area of constant thickness, wherein the cylinder drum 20 is adapted in the sense of a constant width of the gap 25.

Figure 3:
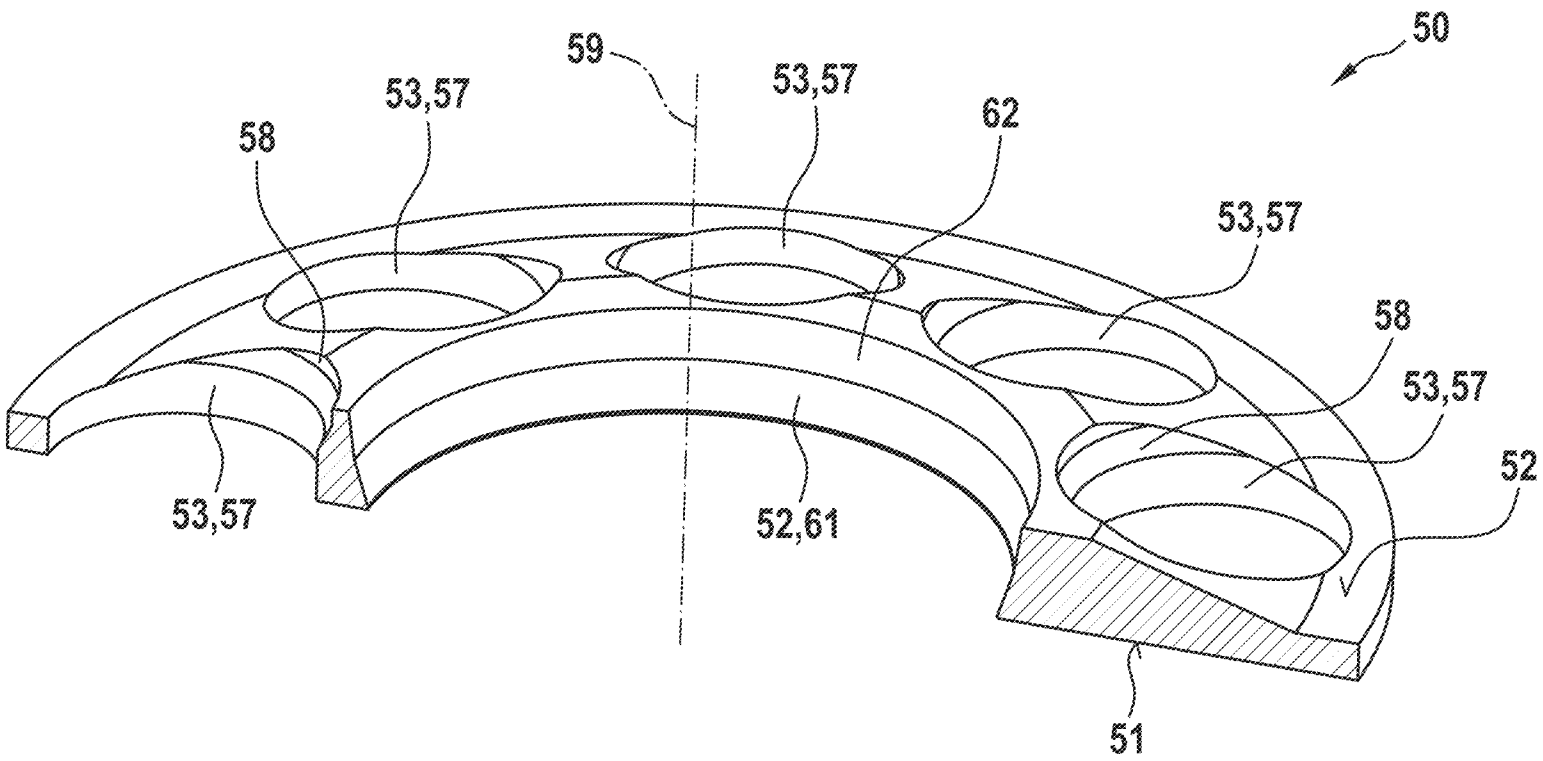
FIG. 3 a perspective sectional view of the retraction plate according to FIG. 2.

FIG. 3 shows a perspective sectional view of the retraction plate 50 according to FIG. 2. The corresponding sectional plane contains the central axis 59, with respect to which the second aperture 54 is rotationally symmetrical. The first end face 51 is flat and perpendicular to this central axis 59. Nine first apertures 53 are arranged around the central axis 59. These are identical to one another, wherein they are arranged uniformly distributed on a common pitch circle, the center of which coincides with the central axis 59.

Each first aperture 53 is rotationally symmetrical with a constant cross-sectional shape, wherein this cross-sectional shape is not completely present radially on the outside due to the variable thickness of the retraction plate 50. The cross-sectional shape is composed of a second circular cylindrical section 57, which is arranged adjacent to the first end face 51. This is adjoined by a funnel-shaped widening 58, which is so large that the associated sliding shoe does not abut against it when it abuts against the second circular cylindrical section 57. It should be noted here that this reference state preferably does not occur during operation of the axial piston machine. However, it can easily be brought about for a single sliding shoe by setting the displacement volume of the assembly shown in FIG. 2 to zero, wherein the retraction plate 50 is displaced radially with respect to the rotation axis. Due to the variable thickness of the retraction plate 50, the funnel-shaped widening 58 is only present at the radially inner edge of a first aperture 53, wherein it is required precisely there.

In FIG. 3 it can also be seen that the central second aperture 54 comprises a first and a second rotationally symmetrical section 61; 62, which in the present case are delimited from one another by an edge.

Figure 4:
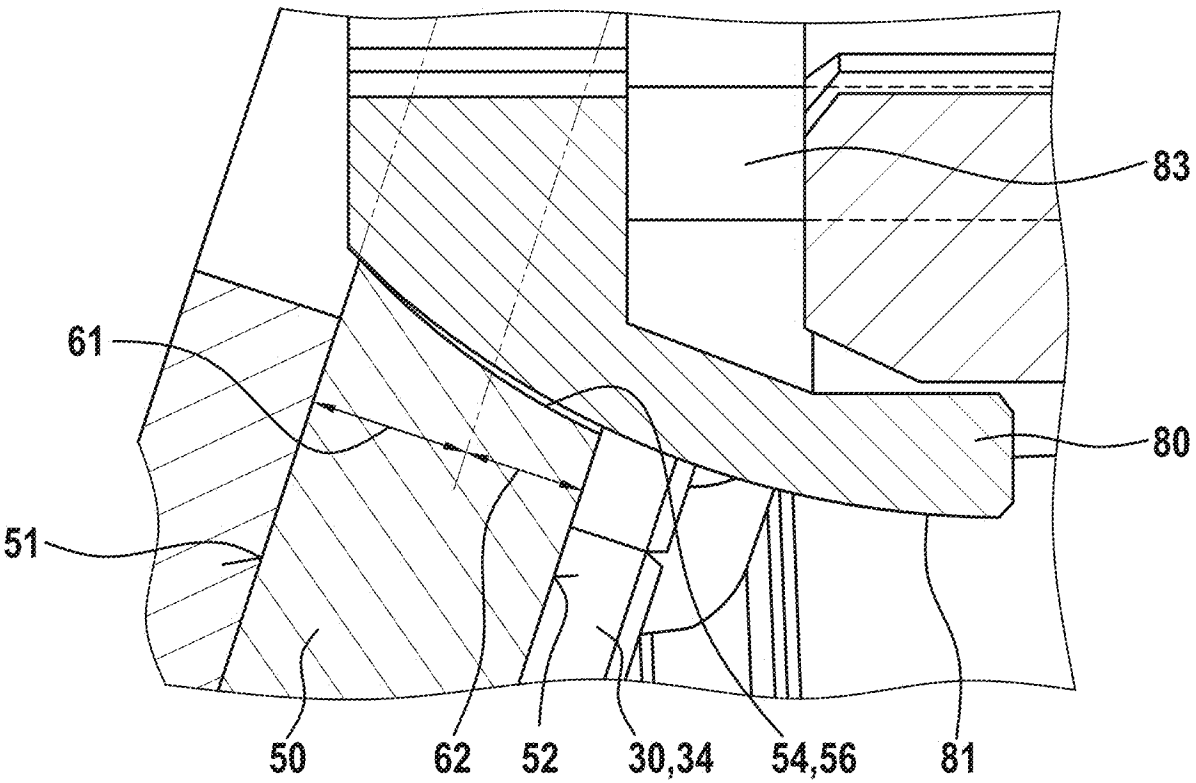
FIG. 4 an enlarged sectional view analogous to FIG. 2 in the area of the retraction ball.

FIG. 4 shows an enlarged sectional view analogous to FIG. 2 in the area of the retraction ball 80. The sectional plane is slightly rotated about the rotation axis compared to FIG. 2, so that the sliding shoe 30 does not fall into the sectional plane. The second aperture 54 of the retraction plate 50 comprises a first and a second rotationally symmetrical section 61; 62, which are directly adjacent to one another in the direction of the central axis (no. 59 in FIG. 3). The contact between the retraction plate 50 and the spherical outer surface section 81 takes place in the first rotationally symmetrical section 61, which is adjacent to the first end face 51.

The first rotationally symmetrical section 61 is shaped like a circular cone, so that a linear contact results over the entire circumference of the retraction ball 80. The second rotationally symmetrical section 62 is spherical in the present case, wherein the corresponding spherical radius is formed larger than the spherical radius of the spherical outer surface section 81 by a predetermined gap dimension. However, the corresponding spherical shape can also be approximated by a circular cone without any significant disadvantages.

This shaping ensures that the distance between the aforementioned linear contact and the first end face 51 is small, but reliably different from zero. Interfering tilting moments on the retraction plate are thus minimized, wherein nevertheless no excessive wear on the inner circumferential surface 56 of the second aperture 54 is to be feared.

REFERENCE NUMERALS

10 Axial piston machine
11 Rotation axis
12 Housing
13 Working port
14 Drive shaft
15 Rotary bearing
16 Distribution plate
20 Cylinder drum
21 Cylinder chamber
22 Piston
23 Ball joint
24 Ball head
25 Gap between retraction plate and cylinder drum
26 Cylinder bore
27 End face of cylinder drum
30 Sliding shoe
31 Ball socket
32 Outer circumferential surface of the sliding shoe
33 Web section
34 Joint section
35 Annular surface
36 Largest diameter of the joint section
37 First circular cylindrical section
50 Retraction plate
51 First end face
52 Second end face
53 First aperture
54 Second aperture
55 Inner circumferential surface of the first aperture
56 Inner circumferential surface of the second aperture
57 Second circular cylindrical section
58 Funnel-shaped widening
59 Central axis of the first aperture
61 First rotationally symmetrical section
62 Second rotationally symmetrical section
63 Corner between first aperture and first end face
64 Corner between second aperture and first end face
70 Swivel cradle
71 Swivel axis
72 Control surface
80 Retraction ball
81 Spherical outer surface section
82 Coil spring
83 Pressure pin
84 Space for cup springs

The invention claimed is:

1. An axial piston machine comprising:

a cylinder drum rotatable with respect to a rotation axis;

a plurality of pistons received in a linearly movable manner in the cylinder drum such that, together with the cylinder drum, the plurality of pistons each delimit an associated cylinder chamber of variable volume;

a plurality of sliding shoes, each of which is connected via a ball joint to a respective piston of the plurality of pistons, the plurality of sliding shoes bearing against a control surface, which is arrangeable at an angle other than 90° inclined to the rotation axis, in a sliding manner, each sliding shoe having an outer circumferential surface that is rotationally symmetrical and is composed of a web section and a joint section, a diameter of the web section greater than a largest diameter of the joint section such that an annular surface is produced at a transition between the web section and the joint section;

a retraction plate comprising:

an associated first aperture for each of the plurality of sliding shoes;

a flat first end face against which the annular surface bears;

a central second aperture that forms a corner with the flat first end face; and a second end face which faces away from the first end face and is rotationally symmetrical, a radially outward distance between the first and second end faces being smaller than a radially inward distance; and a retraction ball having a spherical outer surface section against which an inner circumferential surface of the central second aperture bears, the retraction ball supported on the cylinder drum in a direction of the rotation axis such that the plurality of sliding shoes are pressed against the control surface by the retraction plate, wherein the joint section of each sliding shoe deviates from a circular cylindrical shape such that the joint section has a largest diameter which is spaced apart from the web section, and a reduced diameter between the largest diameter and the web section that is less than the largest diameter, in a reference state, the joint section contacts an inner circumferential surface of the associated first aperture such that a minimum distance is obtained between the web section and the spherical outer surface section, the inner circumferential surface of the associated first aperture is adapted to the non-circular cylindrical joint section of the associated sliding shoe such that said inner circumferential surface and the joint section contact each other in the reference state away from the largest diameter of the joint section, an inner circumferential surface of the central second aperture comprises a first rotationally symmetrical section and a second rotationally symmetrical section which are directly adjacent to each other, and the first rotationally symmetrical section is arranged adjacent to the first end face and the first rotationally symmetrical section is configured to contact the spherical outer surface section of the retraction ball over the entire circumference at the same time as the second rotationally symmetrical section is arranged at a distance from said spherical outer surface section.

2. The axial piston machine according to claim 1, wherein:

the joint section of each sliding shoe comprises a first circular cylindrical section having a diameter that is smaller than the largest diameter of the joint section, the first circular cylindrical section is arranged between the web section and said largest diameter, the inner circumferential surface of the first aperture comprises a second circular cylindrical section, and in the reference state, the first and second circular cylindrical sections are in contact.

3. The axial piston machine according to claim 2, wherein the second circular cylindrical section forms a second corner with the first end face.

4. The axial piston machine according to claim 2, wherein the inner circumferential surface of the first aperture is widened in the shape of a funnel away from the second circular cylindrical section.

5. The axial piston machine according to claim 4, wherein:

the distance between the first and second end faces is such that the funnel-shaped widening is present at a radially inner edge of the first aperture, and only the second circular cylindrical section is present at a radially outer edge of the first aperture.

6. The axial piston machine according to claim 1, wherein the axial piston machine is designed in such a way that the reference state can only be reached when at least part of the axial piston machine is dismantled and/or when the axial piston machine is not pressurized ready for operation, such that during intended operation of the axial piston machine there is always at least some clearance between each sliding shoe and the associated first aperture.

7. The axial piston machine according to claim 1, wherein the second rotationally symmetrical section is spherical in shape and has a spherical radius that is larger than a spherical radius of the spherical outer surface section of the retraction ball.

8. The axial piston machine according to claim 1, wherein the first rotationally symmetrical section is shaped like a circular cone.

9. The axial piston machine according to claim 8, wherein:

the second rotationally symmetrical section is shaped like a circular cone, and an inclination angle between the first rotationally symmetrical section and a central axis of the central second aperture is greater than an analogous inclination angle at the second rotationally symmetrical section.

10. The axial piston machine according to claim 1, wherein:

the spherical outer surface section extends to an end of the retraction ball facing the cylinder drum such that the retraction plate is pivotable beyond said end of the retraction ball, and the distance between the first and the second end faces of the retraction plate is designed such that, in a swivel position of the retraction plate, a gap of constant width is produced between the second end face of the retraction plate and the cylinder drum.

11. The axial piston machine according to claim 1, wherein the corner between the central second aperture and the flat first end face is rounded or chamfered.

12. The axial piston machine according to claim 3, wherein the second corner is rounded or chamfered.

* * * * *